US007844198B2

(12) United States Patent
Kuwabara et al.

(10) Patent No.: US 7,844,198 B2
(45) Date of Patent: Nov. 30, 2010

(54) ELECTROPHOTOGRAPHIC PHOTORECEPTOR, PHOTORECEPTOR SUPPORTING DEVICE, IMAGING DEVICE AND PROCESS CARTRIDGE

(75) Inventors: Nobuo Kuwabara, Yokohama (JP); Hiroyuki Nagashima, Yokohama (JP); Shuji Tanaka, Chigasaki (JP); Hiroshi Ono, Tokyo (JP); Ken Amemiya, Tokyo (JP); Masahiko Shakuto, Zama (JP); Toshio Koike, Kawasaki (JP); Yuji Arai, Kawasaki (JP); Michiya Okamoto, Zama (JP)

(73) Assignee: Ricoh Company, Ltd., Tokyo (JP)

( * ) Notice: Subject to any disclaimer, the term of this patent is extended or adjusted under 35 U.S.C. 154(b) by 57 days.

(21) Appl. No.: 12/350,524

(22) Filed: Jan. 8, 2009

(65) Prior Publication Data

US 2009/0180801 A1 Jul. 16, 2009

(30) Foreign Application Priority Data

Jan. 10, 2008 (JP) ..... 2008-002740

(51) Int. Cl.
*G03G 15/00* (2006.01)

(52) U.S. Cl. ..... 399/117; 399/90

(58) Field of Classification Search ..... 399/90, 399/116, 117, 159
See application file for complete search history.

(56) References Cited

U.S. PATENT DOCUMENTS

| | | | | |
|---|---|---|---|---|
| 5,867,751 | A * | 2/1999 | Nomura et al. | 399/90 |
| 5,878,310 | A * | 3/1999 | Noda et al. | 399/117 |
| 7,003,247 | B2 * | 2/2006 | Koishi et al. | 399/167 |
| 2005/0095033 | A1 * | 5/2005 | Kusano et al. | 399/159 X |
| 2006/0198654 | A1 * | 9/2006 | Noda et al. | 399/90 |

FOREIGN PATENT DOCUMENTS

| | | | |
|---|---|---|---|
| JP | 9-114168 | A | 5/1997 |
| JP | 10-123915 | A | 5/1998 |
| JP | 2001-117309 | A | 4/2001 |
| JP | 3389027 | | 1/2003 |
| JP | 3625927 | | 12/2004 |
| JP | 3792962 | | 4/2006 |
| JP | 2006-313264 | | 11/2006 |
| JP | 2006-313264 | A | 11/2006 |

* cited by examiner

*Primary Examiner*—Sophia S Chen
(74) *Attorney, Agent, or Firm*—Dickstein Shapiro LLP

(57) ABSTRACT

An electrophotographic photoreceptor includes, a cylindrical photoreceptor pipe; at least one flange which is attached to an opening of one end of the photoreceptor pipe, and which is provided with a shaft part projecting outward from the one end at a shaft center position of the photoreceptor pipe; and an earth member which is arranged to penetrate through the shaft part of the at least one flange, and which is provided on its inward side with at least one first contact part which contacts an inner circumference of the photoreceptor pipe, and on its outward side with a second contact part.

7 Claims, 6 Drawing Sheets

ELECTROPHOTOGRAPHIC PHOTORECEPTOR, PHOTORECEPTOR SUPPORTING DEVICE, IMAGING DEVICE AND PROCESS CARTRIDGE

CROSS-REFERENCE TO THE RELATED APPLICATION

The entire contents of Japanese patent application No. JP 2008-002740, filed on Jan. 10, 2008, of which the convention priority is claimed in this application are incorporated hereinto by reference.

BACKGROUND OF THE INVENTION

1. Field of the Invention

The present invention relates to an electrophotographic photoreceptor, a photoreceptor supporting device, an imaging device and a process cartridge. In particular, the present invention relates to the photoreceptor supporting device which is configured to support the electrophotographic photoreceptor. The present invention farther relates to the imaging device in which an image formed on the electrophotographic photoreceptor is transferred directly or indirectly through an intermediate transfer body, and then the image is recorded on a recording material. The imaging device is used in such as a copy machine, a printer, a facsimile, or a complex machine of those. The present invention further relates to the process cartridge which includes the electrophotographic photoreceptor integrated with at least one of a charging device, a developing device and a cleaning device, and which is provided in the imaging device.

2. Description of the Related Art

Conventionally, in an electrophotographic type imaging device, after a surface of an electrophotographic photoreceptor is charged evenly by a charging device, with rotation of the electrophotographic photoreceptor, writing is performed by an exposure device and an electrostatic latent image is formed, and then with a developing device the electrostatic latent image is visualized by adhering toner, and an image is formed on the electrophotographic photoreceptor. The image is then transferred directly) or indirectly through an intermediate transfer body, and then the image is recorded on a recording material such as paper or a resin film.

In such an imaging device, in general, the electrophotographic photoreceptor is supported rotatably by a photoreceptor supporting member through a photoreceptor shaft which penetrates through a shaft center. For example, each of two flanges 2 and 2 is attached to each opening of both ends of a cylindrical photoreceptor pipe 1, as illustrated in FIG. 6A, one photoreceptor shaft 4 penetrates through each of the centers of the flanges 2 and 2 through respective one of hearings 3 and 3, the flanges 2 and 2 are supported rotatably on the photoreceptor shaft 4, and both ends of the photoreceptor shaft 4 are fixed and supported by a couple of photoreceptor supporting members 5 and 5 respectively, the couple of photoreceptor supporting members 5 and 5 being disposed opposed to each other.

In addition, as illustrated in FIG. 6B, for example, each of two flanges 2 and 2 is attached to each opening of both ends of the cylindrical photoreceptor pipe 1, one photoreceptor shaft 4 penetrates through each of the centers of the flanges 2 and 2 and is retained to be rotated together with the flanges 2 and 2, and both ends of the photoreceptor shaft 4 are supported rotatably by a couple of photoreceptor supporting members 5 and 5 which are disposed opposed, respectively, through respective one of bearings 3 and 3.

In addition, an earth member 6 is stored in one of the flanges 2 and 2, for example, the one on the right side in the figure, and a first contact part 6*a* which contacts an inner circumference of the photoreceptor pipe 1 is formed at one end, and a second contact part 6*b* which contacts an outer circumference of the photoreceptor shaft 4 is formed at another end, in the photoreceptor supporting device illustrated in FIGS. 6A and 6B. Here, it is possible for two earth members 6 and 6 to be provided. Moreover, a leading end of an electrical conduction member 7 is elastically pressed against an end face of the photoreceptor shaft 4.

However, problems arise such as the structure is complex, and the photoreceptor shaft 4 of ϕ8 mm to ϕ10 mm is necessary to secure the rigidity, and the cost is high, and wear-out at the second contact part 6*b* is remarkable, for the photoreceptor supporting device illustrated in FIGS. 6A and 6B. That is, due to a stick material generally used as the photoreceptor shaft 4 being ϕ8 mm or more in consideration of the rigidity, etc., the wear-out of the second contact part 6*b* which contacts the outer circumference of the photoreceptor shaft 4 and slides thereon is remarkable, and a conduction assistance material such as conductive grease, a conductive brush, or a carbon terminal or the like is often necessary.

In a conventional imaging device, as illustrated in FIG. 6C, an electrophotographic photoreceptor is supported by cantilevered photoreceptor shafts 8 and 8, instead of the photoreceptor shaft 4 which penetrates through the shaft center, an end of each of the photoreceptor shafts 8 and 8 being retained by the respective photoreceptor supporting member 5. However, in such a photoreceptor supporting device, due to falling of the cantilevered photoreceptor shafts 8 and 8 or the like, leaning or falling of a shaft center of the electrophotographic photoreceptor occurs, and thus problems arise such as easy occurrence of inclination of an image, easy occurrence of distortion of the image resulting from swinging of the photoreceptor by a rotation, and wear-out at the second contact part 6*b*.

Therefore, a photoreceptor supporting device with the following structure is proposed, for example, as illustrated in FIG. 7. Namely, each of two flanges 2 and 2 is attached to each opening of both ends of a cylindrical photoreceptor pipe 1, a shaft part 2*a* projecting outward from the end of the photoreceptor pipe 1 at a shaft center position thereof is formed at each flange 2, and the shaft parts 2*a* and 2*a* are directly supported rotatably by the photoreceptor supporting members 5 and 5 through respective one of bearings 3 and 3, without through the photoreceptor shaft.

In addition, in such a photoreceptor supporting device, a bracket 9 is attached to the photoreceptor supporting member 5 on one side, for example on the right side in FIG. 7, and the end of one of the cantilevered photoreceptor shafts 8 and 8 (for example the one on the right side in FIG. 7), is retained by the bracket 9. Further, at least one earth member 6 is provided, and a first contact part 6*a* which contacts an inner circumference of the photoreceptor pipe 1 is formed at one end, and a second contact part 6*b* which contacts an outer circumference of the cantilevered photoreceptor shaft 8 is formed at another end of the earth member 6, moreover, a leading end of an electrical conduction member 7 is elastically pressed against an outer end face of the photoreceptor shaft 8, and an electrical connection is formed.

However, even with this structure, problems still arise, such as a complicated structure and high cost, and many contact parts being required for electrical connection, remarkable wear-out at the second contact part 6*b*, and decrease of the reliability of the conduction.

SUMMARY OF TEE INVENTION

At least an object of the present invention is to provide, for example, an electrophotographic photoreceptor, which has a simple structure and is low cost, and in which the stability of electrical conduction is improved.

Another object of the present invention is to reduce the wear-out of a second contact part of an earth member provided in the electrophotographic photoreceptor, and to improve long-life of the electrophotographic photoreceptor.

A further object of the present invention is to reduce an amount of sliding per rotation between the second contact part and an electrical conduction member more easily, to reduce the wear-out of the second contact part, and to improve the long-life of the electrophotographic photoreceptor.

A further object of the present invention is to provide, for example, a photoreceptor supporting device provided with an electrophotographic photoreceptor, the electrophotographic photoreceptor including few components and having a simple structure and being low cost and in which the stability of electrical conduction is improved.

A further object of the present invention is to provide, for example, an imaging device provided with an electrophotographic photoreceptor, the electrophotographic photoreceptor including few components and having a simple structure and being low cost, and in which the stability of electrical conduction is improved.

A further object of the present invention is to provide, for example, a process cartridge provided with an electrophotographic photoreceptor, the electrophotographic photoreceptor including few components and having a simple structure and being low cost, and in which the stability of electrical conduction is improved.

In light of the above-mentioned, the present invention proposes, for example, an electrophotographic photoreceptor including: a cylindrical photoreceptor pipe; at least one flange which is attached to an opening of one end of the photoreceptor pipe, and which is provided with a shaft part projecting outward from the one end at a shaft center position of the photoreceptor pipe; and an earth member which is arranged to penetrate through the shaft part of the at least one flange, and which is provided on its inward side with at least one first contact part which contacts an inner circumference of the photoreceptor pipe, and on its outward side with a second contact part.

BRIEF DESCRIPTION OF THE DRAWINGS

The invention will be described further below with reference to exemplary embodiments and the accompanying schematic drawings, in which.

DETAILED DESCRIPTION OF THE PREFERRED EMBODIMENTS

Figure 1:
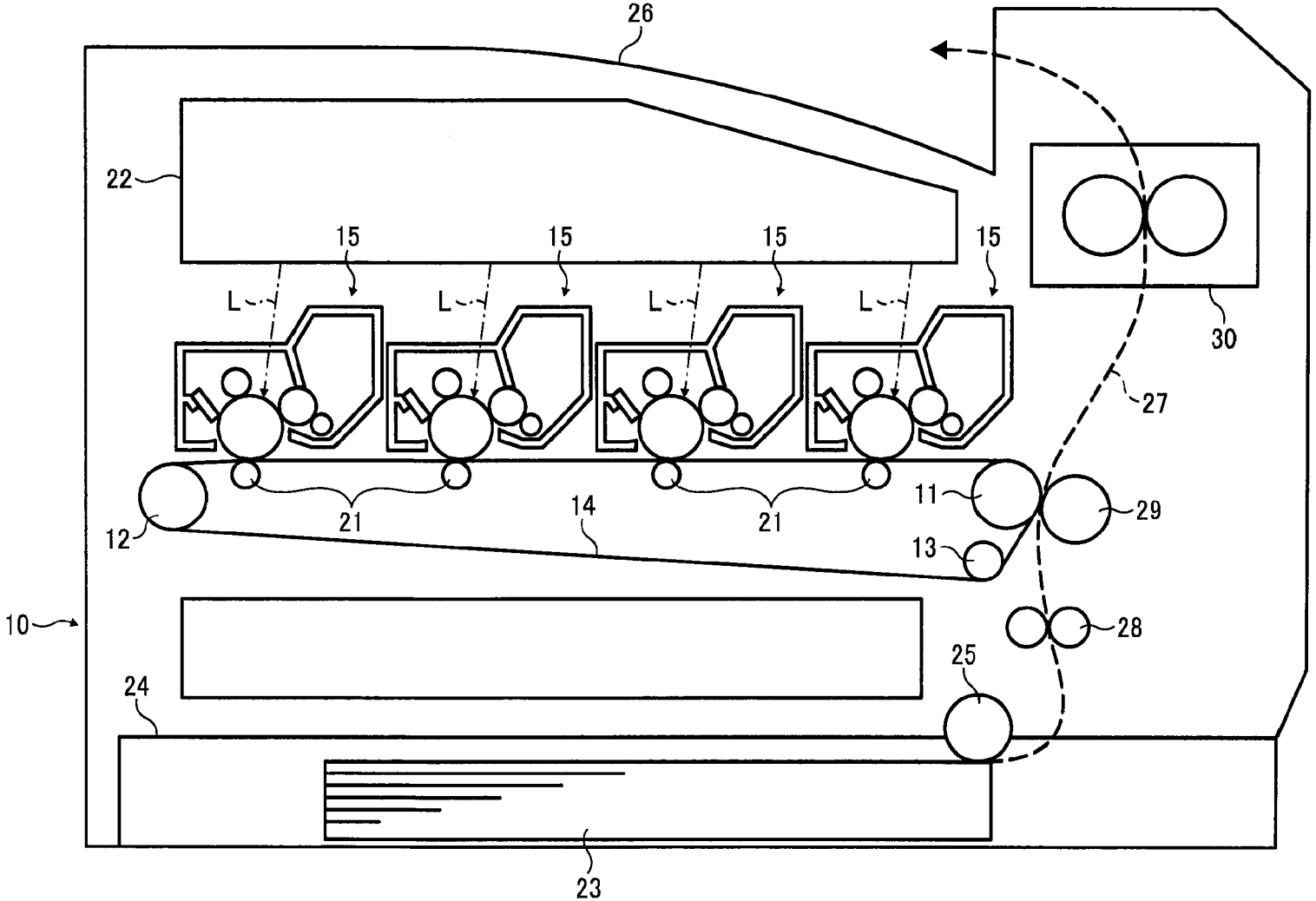
FIG. 1 illustrates a schematic structure of an internal mechanism in a tandem type full-color imaging device according to the present invention.

FIG. 1, reference number 10 represents an imaging device main body.

In a center of the imaging device main body 10, an intermediate transfer body 14 which is formed in an endless belt shape is wound around three rollers 11 to 13 and is turned by the three rollers. And, four process cartridges 15 with different colors are arranged in a tandem manner on a horizontal part of the intermediate transfer body 14 between the roller 11 and the roller 12. Each of the process cartridges 15 houses a different color toner, and all the process cartridges 15 are formed with the same structure.

Figure 2:
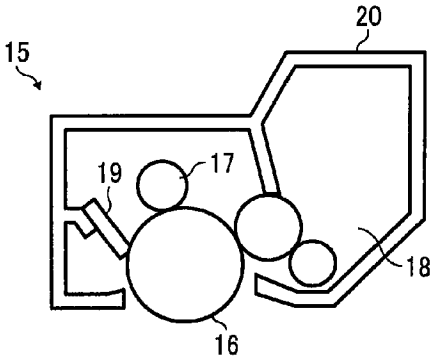
FIG. 2 illustrates a structure of a process cartridge provided in the full-color imaging device according to the present invention.

FIG. 2 illustrates a structure of one of the process cartridges 15.

As illustrated in the figure, an electrophotographic photoreceptor 16 in a drum shape is provided in each of the process cartridges 15, and a charging device 17 which is configured to charge a surface of the electrophotographic photoreceptor 16 evenly, a developing device 18 which is configured to develop an electrostatic latent image on the electrophotographic photoreceptor 16, and a cleaning device 19 which is configured to clean the surface of the electrophotographic photoreceptor 16 or the like are arranged around a circumference of the electrophotographic photoreceptor 16. All the devices are housed in one cartridge case 20 which is provided as a photoreceptor supporting member (device) and are integrated, and are all detachable from the imaging device main body 10.

In the imaging device main body 10, a plurality of transfer devices 21, for example in this embodiment, four transfer devices 21 are provided, and each of which is located at a position opposed to the electrophotographic photoreceptor 16 of each of the process cartridges 15, through the intermediate transfer body 14, as illustrated in FIG. 1. In addition, an exposure device 22 is arranged above the four process cartridges 15.

Further, a paper feed cassette 24 which is configured to house paper 23 as a recording material is provided at the bottom of the imaging device main body 10, and which can be freely pulled out and pushed in. In addition, a paper feed roller 25 is provided on an end of the paper feed cassette 24, and a paper path 27 is formed upward towards a paper ejecting stack part 26 provided on the imaging device main body 10 from where the paper feed roller 25 is disposed. A pair of resist rollers 28, a second transfer device 29 which is provided opposed to the roller 11 through the intermediate transfer body 14, and a fixing device 30 or the like are arranged sequentially on the paper path 27, from the bottom to the top of the imaging device main body 10.

When an image is recorded on the paper 23, first, with a rotation of each electrophotographic photoreceptor 16 in a clockwise direction in the figure, the surface of each electrophotographic photoreceptor 16 is charged evenly, by applying a bias voltage with the respective charging device 17.

And then, writing is performed by irradiating laser light L from the exposure device 22 based on an image signal sent from a host or the like, and an electrostatic latent image is formed on each electrophotographic photoreceptor 16. After that, toner is adhered and the electrostatic latent image is visualized by the respective developing device 18, and each color monochromatic image is formed on the respective electrophotographic photoreceptor 16.

In addition, the intermediate transfer body 14 runs in an anticlockwise direction in the figure, and each of the monochromatic images on respective electrophotographic photoreceptors 16 is firstly transferred to the intermediate transfer body 14 sequentially by the transfer device 21, and the images transferred are superimposed together, and then a full-color image is formed on the intermediate transfer body 14.

Meanwhile, the paper feed roller 25 is rotated at a suitable timing, and then the paper 23 is fed from the paper feed cassette 24 of the imaging device main body 10, and is conveyed through the paper path 27 and then the paper 23 strikes between the pair of resist rollers 28 and stops. And, the pair of resist rollers 28 are rotated matching a tiring of the full-color image on the intermediate transfer body 14, and the full-color image is secondarily transferred to the paper 23 by the second transfer device 29. After that, the paper 23 on which the full-color image has been transferred is conveyed through the paper path 27 continuously upward, and unfixed transfer toner is fixed on the paper 23 when the paper 23 passes through a fixing nip of the fixing device 30, and then the paper 23 is ejected by an ejecting roller which is not illustrated in the figure, and is stacked on the paper ejecting stack part 26 of the imaging device main body 10.

Each electrophotographic photoreceptor 16 after the first transfer is cleaned by the cleaning device 19 to remove the remaining transfer toner, and is initialized.

In addition, the intermediate transfer body 14 after the second transfer is cleaned by a second cleaning device which is not illustrated, to remove the remaining transfer toner, and is initialized.

When such as a black-and-white image or a two-color image is recorded, an appropriate process cartridge 15 of four process cartridges 15 is selectively driven and the image is recorded on the paper 23 similarly.

Figure 3:
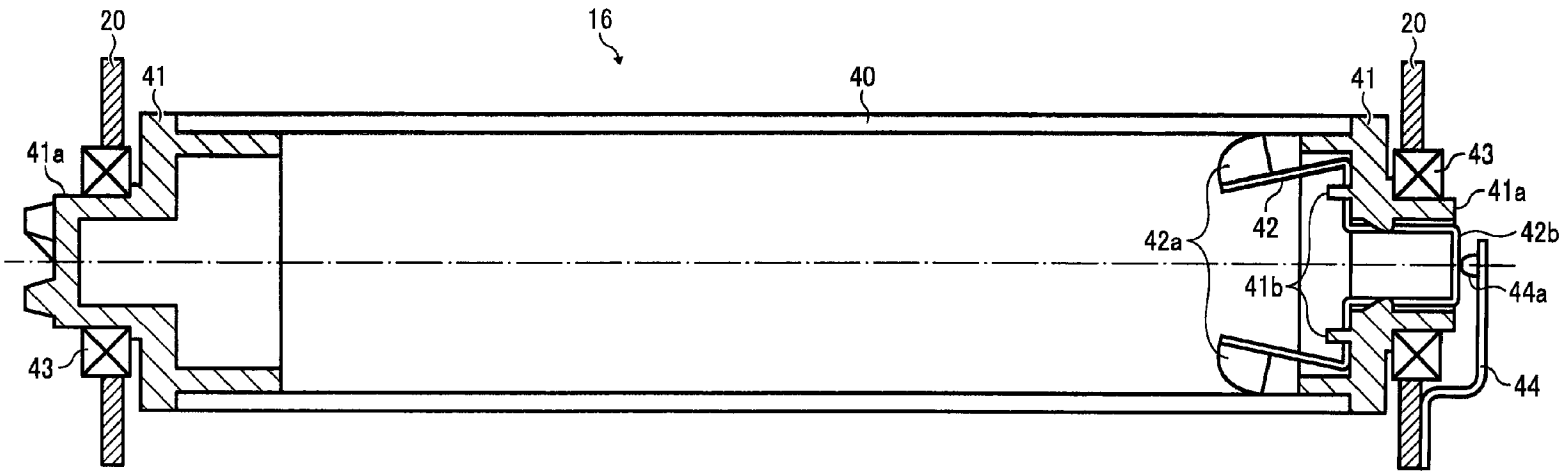
FIG. 3 illustrates a cross-sectional structure of a photoreceptor supporting device provided in the process cartridge according to the present invention.

FIG. 3 illustrates a cross-sectional structure of the photoreceptor supporting device.

The electrophotographic photoreceptor 16 includes a cylindrical photoreceptor pipe 40, two flanges 41, and an earth member 42, as illustrated in the figure. Each of the two flanges 41 is attached to each opening of both ends of the photoreceptor pipe 40, and a shaft part 41*a* projecting outward from the end of the photoreceptor pipe 40 at a shaft center position thereof is formed at each flange 41. In the present embodiments two flanges 41 have different shapes, and for example, in FIG. 3, the flange 41 on the right side is provided with a through-hole which penetrates through the shaft part 41*a*. The earth member 42 is attached and fitted to the through-hole of the flange 41 on the right side, and in the present embodiment, two first contact parts 42*a* each of which contacts an inner circumference of the photoreceptor pipe 40 is formed on an inward side of the earth member 42, and a second contact part 42*b* is formed on its outward side. Further, the earth member 42 can be provided with one or more than one first contact part 42*a*.

Figure 4A:
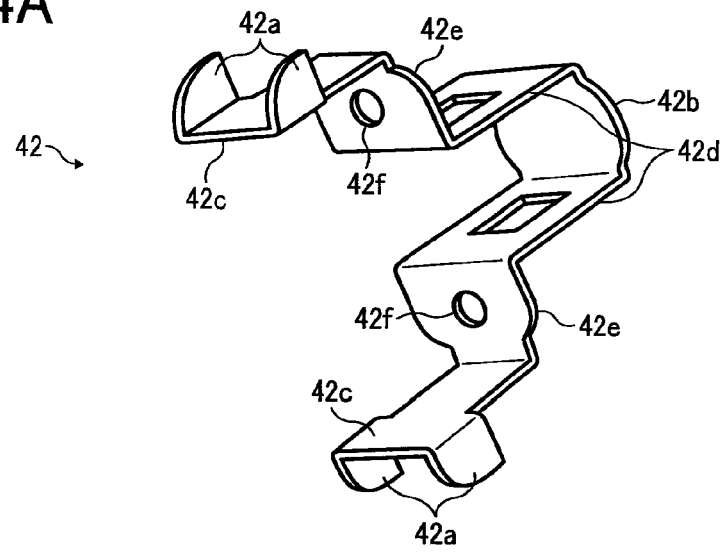
FIG. 4A illustrates a perspective view of an earth member provided in an electrophotographic photoreceptor according to a first embodiment of the present invention.

FIG. 4A illustrates an external shape of the earth member 42.

The earth member 42 is formed with, for example, an elastic plate. The elastic plate is bent to form a convex shape, and each of the first contact parts 42*a* is formed by bending both ear parts of the right and left of each edge 42*c* outwardly, and the second contact part 42*b* is formed on a convex shape top surface in the middle, and two narrow parts 42*d* and two step parts 42*e* are provided, and on each of the step parts 42*e* a dowel hole 42*f* is provided.

Figure 4B:
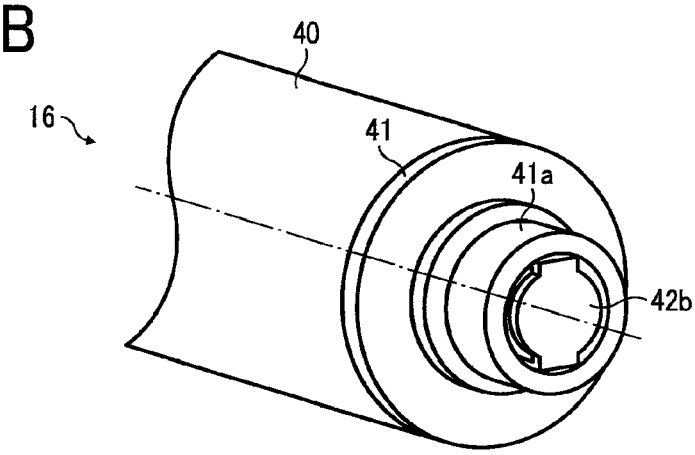
FIG. 4B illustrates a perspective view of an end on one side of the electrophotographic photoreceptor according to the first embodiment of the present invention.

And, as illustrated in FIG. 3, the two narrow parts 42*d* are inserted from the inside into the through-hole formed at the shaft part 41*a* of the flange 41, each of the step parts 42*c* is struck to an inner face of the flange 41 and each positioning dowel 41*b* of the flange 41 is inserted into the respective dowel hole 42*f*, and the second contact part 42*b* is exposed outside, as illustrated in FIG. 4B. Afterward, the flange 41 fitted with the earth member 42 is fitted to the photoreceptor pipe 40, and each edge 42*c* bends inward against the elasticity, and each of the first contact parts 42*a* is brought into contact with the inner circumference of the photoreceptor pipe 40 by a repulsive force. Another flange 41 without the through-hole is attached to the other end of the photoreceptor pipe 40.

The electrophotographic photoreceptor 16 with the above-mentioned structure is attached to the imaging device main body 10 detachably, by supporting each of the two shaft parts 41*a* with the cartridge case 20 through a respective bearing 43, and putting an electrical conduction member 44 into contact with the second contact part 42*b*, and detaching the process cartridge 15. The electrical conduction member 44 is formed by bending an elastic plate, as well as the earth member 42, and a convex contact point 44*a* is provided at a leading end of the electrical conduction member 44. The electrical conduction member 44 is attached to the cartridge case 20 or the like and is supported thereof, and the contact point 44*a* is brought into contact with the second contact part 42*b*, for example, at the center position of the second contact part 42*b*.

Figure 4C:
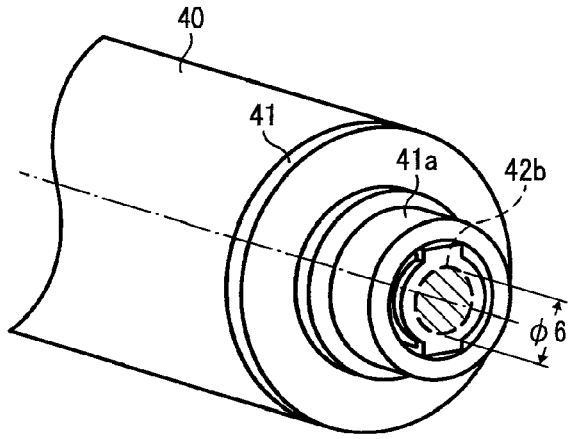
FIG. 4C illustrates a perspective view of an end on one side of an electrophotographic photoreceptor according to a second embodiment of the present invention.

As illustrated in FIG. 4C, when the second contact part 42*b* of the earth member 42 provided in the electrophotographic photoreceptor 16 is arranged in a range with a diameter within 6 mm, which centers on the shaft center of the photoreceptor pipe 40 (as illustrated with a diagonal line in the figure), an amount of sliding between the second contact part 42*b* and the electrical conduction member 44 per rotation can be decreased and the wear-out of the second contact part 42*b* is reduced, and the long-life of the electrophotographic photoreceptor 16 can be improved.

Figure 5A:
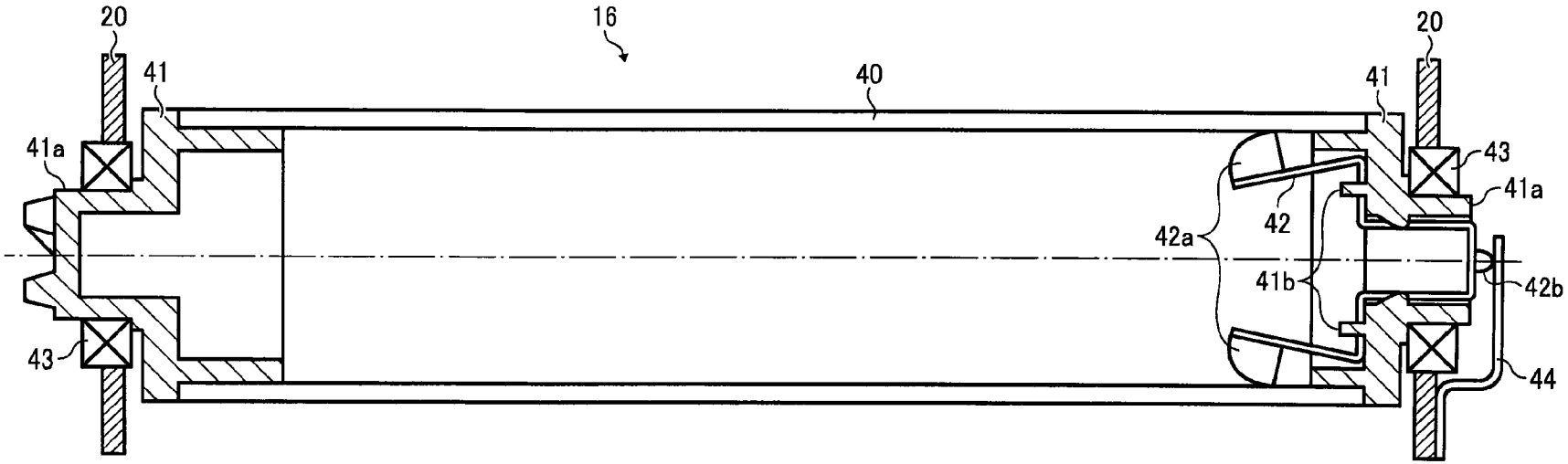
FIG. 5A illustrates a cross-sectional structure of a photoreceptor supporting device according to a third embodiment of the present invention.
Figure 5B:
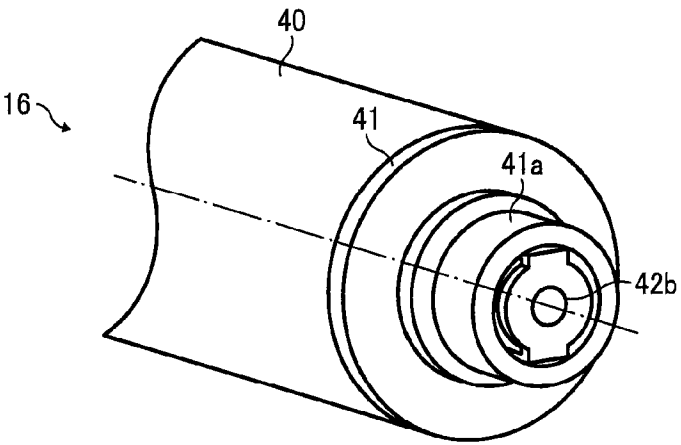
FIG. 5B illustrates a perspective view of an end on one side of an electrophotographic photoreceptor provided in the photoreceptor supporting device according to the third embodiment of the present invention.
Figure 6A:
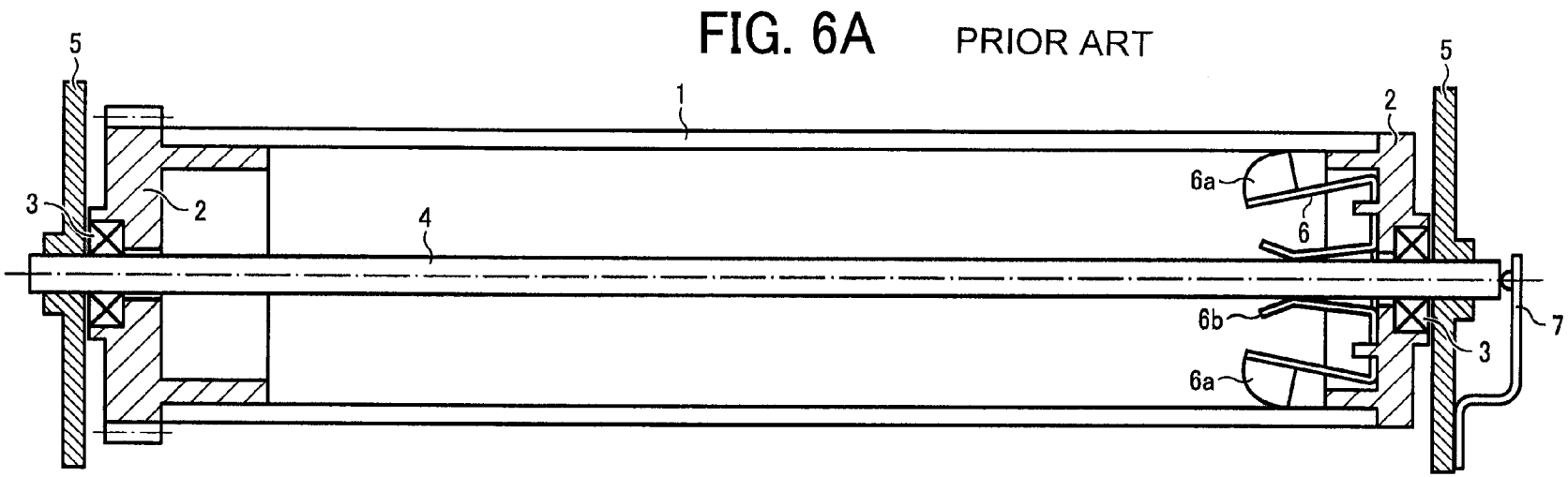
FIG. 6A PRIOR ART
FIG. 6A illustrates a cross-sectional structure of a first embodiment of a conventional photoreceptor supporting device.
Figure 6B:
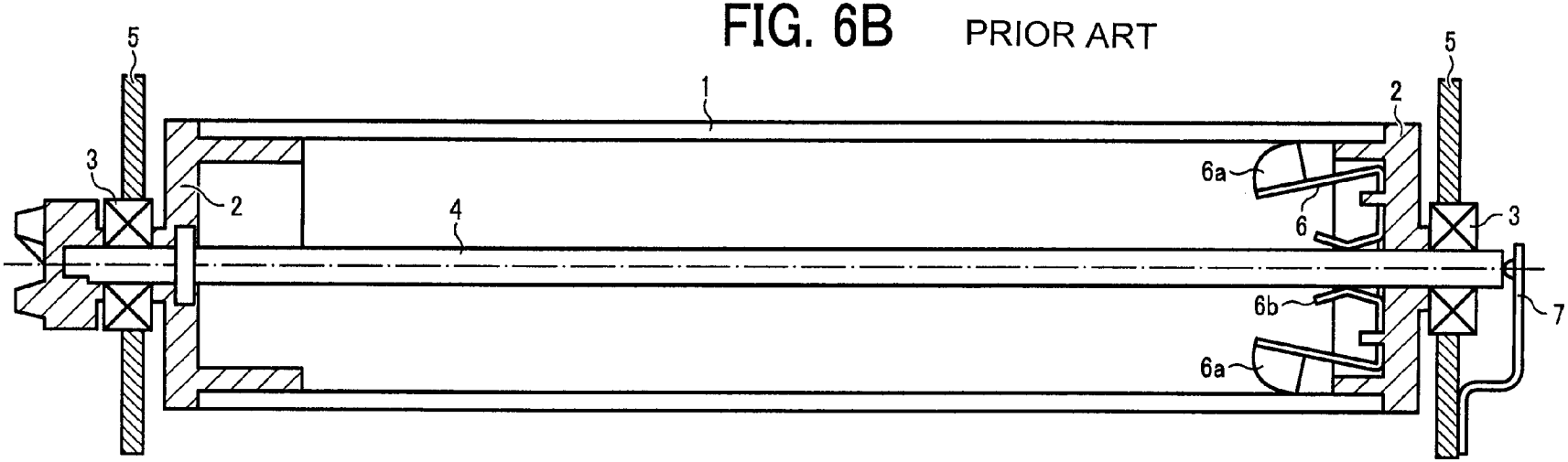
FIG. 6B PRIOR ART
FIG. 6B illustrates a cross-sectional structure of a second embodiment of the conventional photoreceptor supporting device.
Figure 6C:
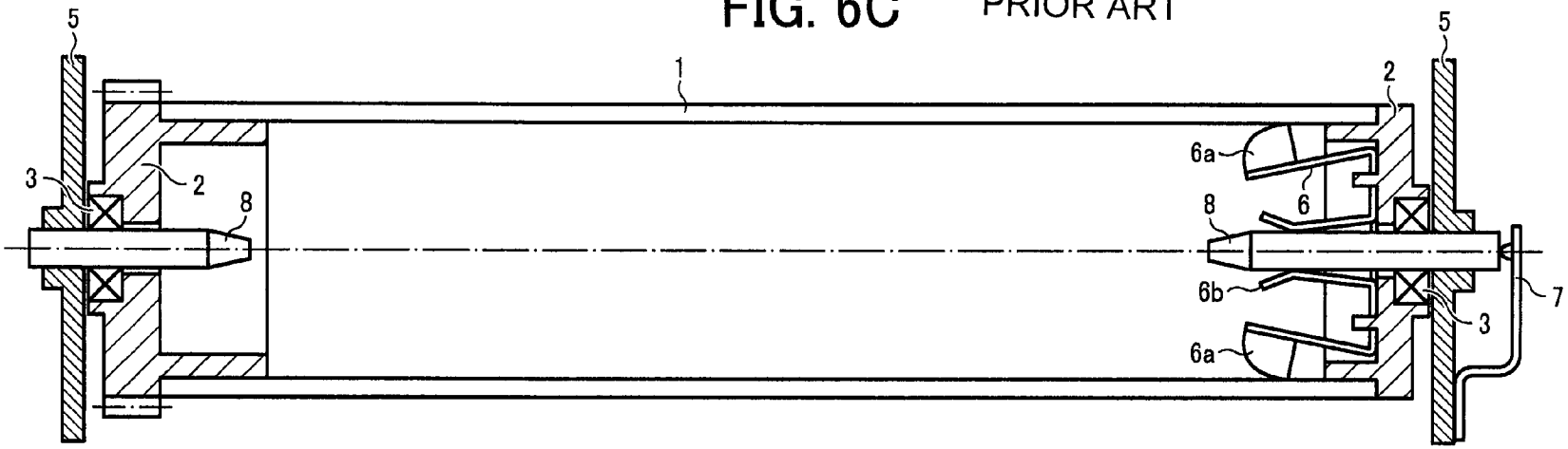
FIG. 6C PRIOR ART
FIG. 6C illustrates a cross-sectional structure of a third embodiment of the conventional photoreceptor supporting device.
Figure 7:
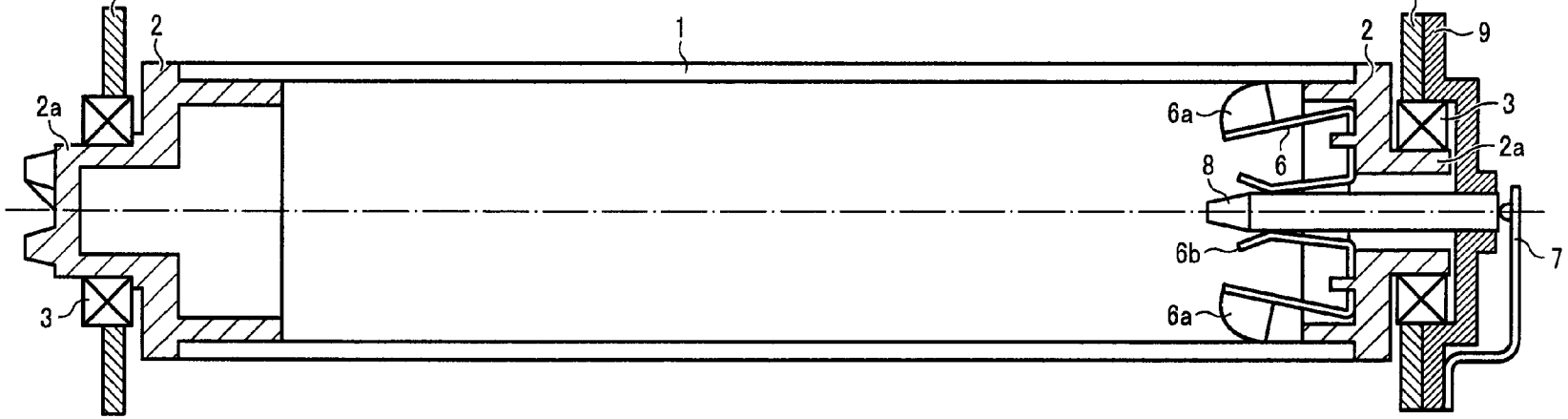
FIG. 7 PRIOR ART
FIG. 7 illustrates a cross-sectional structure of a fourth embodiment of the conventional photoreceptor supporting device.

Moreover, as illustrated in FIGS. 5A and 5B, the second contact part 42*b* is formed in a convex shape projecting outward and centering on the shaft center of the photoreceptor pipe 40, an amount of sliding between the second contact part 42*b* and the electrical conduction member 44 per rotation is decreased more easily, and the wear-out of the second contact part 42*b* is reduced, and the long-life of the electrophotographic photoreceptor 16 can be improved.

In the conventional technology, when the sliding contact occurs at the circumference of the photoreceptor shaft which has a diameter of 8 mm, the sliding distance per rotation is the length of the circumference which is calculated by, 8 mm×pi (3.14), i.e., about 25.13 mm.

However, in the embodiment of the present invention, when the second contact part 42*b* is arranged in the range with the diameter within 6 mm which centers on the shaft center of the photoreceptor pipe 40, and for example, if the contact point 44*a* is brought into contact with the second contact part 42*b* at a position which is farthest from the center of the second contact part 42*b*, the sliding distance per rotation is calculated by 6 mm×pi (3.14), i.e. about 18.84 mm, namely, the sliding distance per rotation can be decreased by about 25%. In addition, when the second contact part 42*b* is formed in the convex shape projecting outward and centering on the shaft center of the photoreceptor pipe 40, even if a position tolerance is ±0.3 mm, the sliding distance per rotation is calculated by 0.6 mm×pi (3.14), i.e., about 1.884 mm, namely, the sliding distance can be decreased by 90% or more.

In the above-mentioned embodiments, an application of the present invention to the tandem type full-color imaging device is explained. In a color imaging device, generation of color superimposition shift due to distortion of each color image can be suppressed, and an excellent image can be provided, in addition, the present invention is not limited to the imaging device provided with a plurality of electrophotographic photoreceptors, it can be applied to an imaging device which is provided with only one electrophotographic photoreceptor, as well.

According to an aspect of the present invention, it can provide an electrophotographic photoreceptor with few components and a simple structure, and at low cost. In addition, in the electrophotographic photoreceptor, an earth member is provided on its inward side with at least one first contact part which contacts an inner circumference of a photoreceptor pipe, and with a second contact part on its outward side, therefore the contact portion for electrical conduction can be reduced, and the wear-out of the contact portion can be decreased, and the stability of electrical conduction can be improved.

According to a preferable embodiment of the present invention, an amount of sliding between the second contact part and an electrical conduction member per rotation can be decreased, and the wear-out of the second contact part can be reduced, and the long-life of the electrophotographic photoreceptor can be improved.

According to another preferable embodiment of the present invention, to reduce an amount of sliding per rotation between the second contact part and the electrical conduction member, it is preferable to dispose the electrical conduction member close to a shaft center of a photoreceptor pipe as much as possible and make the electrical conduction member abut with the earth member there. Consequently, due to it being easy to form the second contact part in a convex shape which centers on the shaft center of the photoreceptor pipe, rather than to improve attachment accuracy of the electrical conduction member, according to the present invention, the electrical conduction member can be disposed close to the shaft center of the photoreceptor pipe and abut with the earth member there more easily, and the amount of sliding between the second contact part and the electrical conduction member per rotation can be reduced.

According to a further preferable embodiment of the present invention, it can provide a photoreceptor supporting device which includes an electrophotographic photoreceptor with few components and a simple structure and at low cost, and in which the stability of electrical conduction is improved.

According to a further preferable embodiment of the present invention, it can provide an imaging device which includes an electrophotographic photoreceptor with few components and a simple structure and at low cost, and in which the stability of electrical conduction is improved.

According to a further preferable embodiment of the present invention, it can provide a process cartridge which includes an electrophotographic photoreceptor with few components and a simple structure and at low cost, and in which the stability of electrical conduction is improved.

It should be noted that although the present invention has been described with respect to exemplary embodiments, the invention is not limited thereto. In view of the foregoing, it is intended that the present invention cover modifications and variations provided they fall within the scope of the following claims and their equivalent.

What is claimed is:

1. A process cartridge having a cartridge case, comprising:

an electrophotographic photoreceptor including:

a cylindrical photoreceptor pipe;

at least one flange which is attached to an opening of one end of the photoreceptor pipe, and which is provided with a shaft part projecting outward from the one end at a shaft center position of the photoreceptor pipe; and an earth member which is arranged to penetrate through the shaft part of the at least one flange, and which is provided on its inward side with at least one first contact part which contacts an inner circumference of the photoreceptor pipe, and on its outward side with a second contact part;

an electrical conduction member which is attached to the cartridge case and is supported thereby; and at least one of a charging device which is configured to charge a surface of the electrophotographic photoreceptor evenly, a developing device which is configured to develop an electrostatic latent image on the electrophotographic photoreceptor, and a cleaning device which is configured to clean the surface of the electrophotographic photoreceptor, wherein the electrophotographic photoreceptor is supported by the cartridge case at least at the shaft part of the at least one flange through a bearing, and the electrical conduction member attached to the cartridge case is brought into contact with the second contact part of the electrophotographic photoreceptor, and wherein the process cartridge is detachable to an imaging device main body.

2. A process cartridge according to claim 1, wherein the earth member of the electrophotographic photoreceptor is formed by bending an elastic plate.

3. A process cartridge according to claim 2, wherein the earth member of the electrophotographic photoreceptor has two first contact parts and one second contact part, each of the two first contact parts is formed by bending both ear parts of the right and left of each edge of the elastic plate, and the one second contact part of the earth member is formed on a convex shape top surface in the middle of the elastic plate.

4. A process cartridge according to claim 2, wherein the earth member has at least one step part on which a dowel hole is provided, the at least one step part is attached to an inner face of the at least one flange, and a positioning dowel of the at least one flange is inserted into the dowel hole.

5. A process cartridge according to claim 1, wherein the second contact part of the earth member is exposed outside of the at least one flange.

6. A process cartridge according to claim 1, wherein the second contact part of the earth member is arranged in a range with a diameter within 6 mm which centers on the shaft center position of the photoreceptor pipe of the electrophotographic photoreceptor.

7. A process cartridge according to claim 1, wherein the second contact part of the earth member is formed in a convex shape projecting outward and centering on the shaft center position of the photoreceptor pipe of the electrophotographic photoreceptor.

* * * * *